US008448623B2

(12) United States Patent
Kataoka

(10) Patent No.: US 8,448,623 B2
(45) Date of Patent: May 28, 2013

(54) INTERNAL COMBUSTION ENGINE

(75) Inventor: Hiroki Kataoka, Fukuroi (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 405 days.

(21) Appl. No.: 12/850,655

(22) Filed: Aug. 5, 2010

(65) Prior Publication Data

US 2011/0030647 A1 Feb. 10, 2011

(30) Foreign Application Priority Data

Aug. 7, 2009 (JP) ..... 2009/184812

(51) Int. Cl.
*F02B 75/22* (2006.01)

(52) U.S. Cl.
USPC ..... 123/195 R; 123/196 R; 123/196 CP

(58) Field of Classification Search
USPC ..... 123/195 R, 196 R, 196 CP
See application file for complete search history.

(56) References Cited

U.S. PATENT DOCUMENTS 2,058,350 A * 10/1936 Petter ..... 123/65 E

FOREIGN PATENT DOCUMENTS

| | | |
|---|---|---|
| JP | 61-182406 | 8/1986 |
| JP | 64-22812 | 2/1989 |
| JP | 2002-256838 | 9/2002 |
| JP | 2007/064081 | 3/2007 |
| JP | 2009-184812 | 8/2009 |

* cited by examiner

*Primary Examiner* — Noah Kamen
(74) *Attorney, Agent, or Firm* — Barnes & Thornburg LLP

(57) ABSTRACT

An internal combustion engine includes a crankcase unit forming a crank chamber, a cylinder having a cylinder bore and a projecting portion extending toward the crankcase unit so as to be coupled thereto, a piston that reciprocates in the cylinder bore of the cylinder provided with the projecting portion. The crankcase unit has a wall section and a space is formed between the projecting portion of the cylinder and the wall section of the crankcase unit when the crank case unit and cylinder having the projecting portion is coupled, and the space formed between the projecting portion of the cylinder and the wall section of the crankcase unit and an outside space of the crank chamber are communicated by a communicating groove which is provided to at least either one of the cylinder and the crankcase unit.

4 Claims, 6 Drawing Sheets

INTERNAL COMBUSTION ENGINE

CROSS-REFERENCE TO RELATED APPLICATIONS

The present application claims the benefit of priority to Japanese Patent Application No. 184812/2009 filed 7 Aug. 2009, the contents of which are incorporated herein by reference in their entirety.

BACKGROUND OF THE INVENTION

1. Field of the Invention

The present invention relates to an internal combustion engine specifically including a crank chamber having a closed structure.

2. Related Art

In general, an engine includes a piston, and for a conventional four stroke engine, when a piston moves from the bottom dead center to the top dead center in a cylinder, a negative pressure is produced in the closed crank chamber to prevent the lifting of the piston. Against such defective matter, a conventional technology provided a solution, for example, disclosed in Patent Document 1 (Japanese Patent Application Laid-Open Publication No. 61-182406), which discloses an internal combustion engine, in which a balancing hole is formed in a side wall of a cylinder so as to communicate an interior of the crank chamber with an exterior thereof, thereby preventing an increasing of a negative pressure in the crank chamber.

However, the internal combustion engine described in Patent Document 1 has such a disadvantage as that the balancing hole is closed when the piston is positioned at a bottom position of the cylinder, and in such occurrence, the negative pressure in the crank chamber cannot be effectively prevented until the balancing hole has been opened even if the piston is being lifted.

Further, it may be considered, for preventing the balancing hole from being closed by the movement of the piston, to form the balancing hole in the crank chamber. However, in a certain case, the engine lubricant oil used for the internal combustion engine may be contained with abrasion particles produced by abrasion of the cylinder or other components, and the abrasion particles may block the balancing hole. According to this reason, it is not preferred to form the balancing hole in a range near a surface of the lubricant oil or in an oil reaching range of the lubricant oil sprayed from the rotating crank shaft.

SUMMARY OF THE INVENTION

The present invention was conceived in consideration of the circumstances encountered in the prior art mentioned above and an object thereof is to provide an internal combustion engine that can surely suppress an application of an excessive negative pressure caused in a crank chamber when a piston moves from a bottom dead center to a top dead center with high reliability.

The above and other objects can be achieved according to the present invention by providing an internal combustion engine including: a crankcase unit forming a crank chamber; a cylinder having a cylinder bore and a projecting portion extending toward the crankcase unit so as to be coupled thereto; a piston that reciprocates in the cylinder bore of the cylinder; and a crank shaft rotatably supported in the crankcase unit, in which a reciprocating motion of the piston is converted into a rotational motion of the crank shaft, wherein the crankcase unit has a wall section and a space is formed between the projecting portion of the cylinder and the wall section of the crankcase unit when the crank case unit and cylinder having the projecting portion is coupled, and the space formed between the projecting portion of the cylinder and the wall section of the crankcase unit and an outside space of the crank chamber are communicated through a communicating passage which is provided to at least either one of the cylinder and the crankcase unit.

In a preferred embodiment of the above aspect, it may be desired that the space outside the crank chamber constitutes a cam chain chamber disposed adjacent to the crank chamber.

The communicating passage may be preferably composed of a communicating groove formed to one of a cylinder-side contact surface and a crankcase-unit-side contact surface of contact surfaces of the crankcase unit and the cylinder. The communicating groove may be formed only to the cylinder-side contact surface of the cylinder.

The communicating passage may be preferably composed of communicating grooves formed to both a cylinder-side contact surface and a crankcase-unit-side contact surface of contact surfaces of the crankcase unit and the cylinder.

It may be desired that a gasket is provided between the contact surface between the crankcase unit and the cylinder and the communicating member is formed in the gasket.

The crankcase unit may include at least laterally arranged two crankcases.

According to the present invention of the characters mentioned above, the space formed between the projecting portion (skirt portion) of the cylinder extending toward the crank case unit and the wall of the crankcase unit located at the outer side of the skirt portion is a part of the crank chamber and is in communication with a space outside the crank chamber through the communicating member such as groove. The communicating member is formed at the outer side of the skirt portion, and therefore, any droplet of the lubricant oil in the crank chamber does not block the communicating member. Thus, the communicating member can surely prevent an excessive negative pressure from occurring in the crank chamber when the piston moves from the bottom dead center to the top dead center.

The nature and further characteristic features will be made clearer from the following descriptions made with reference to the accompanying drawings.

DESCRIPTION OF THE PREFERRED EMBODIMENT

In the following, a best mode carrying out the present invention will be described with reference to the accompanying drawings. Further, it is to be noted that terms "upper", "lower", "right", "left" and the like terms are used herein with reference to illustrations on the accompanying drawings or in an actually installed state of an internal combustion engine to a motorcycle.

Figure 1:
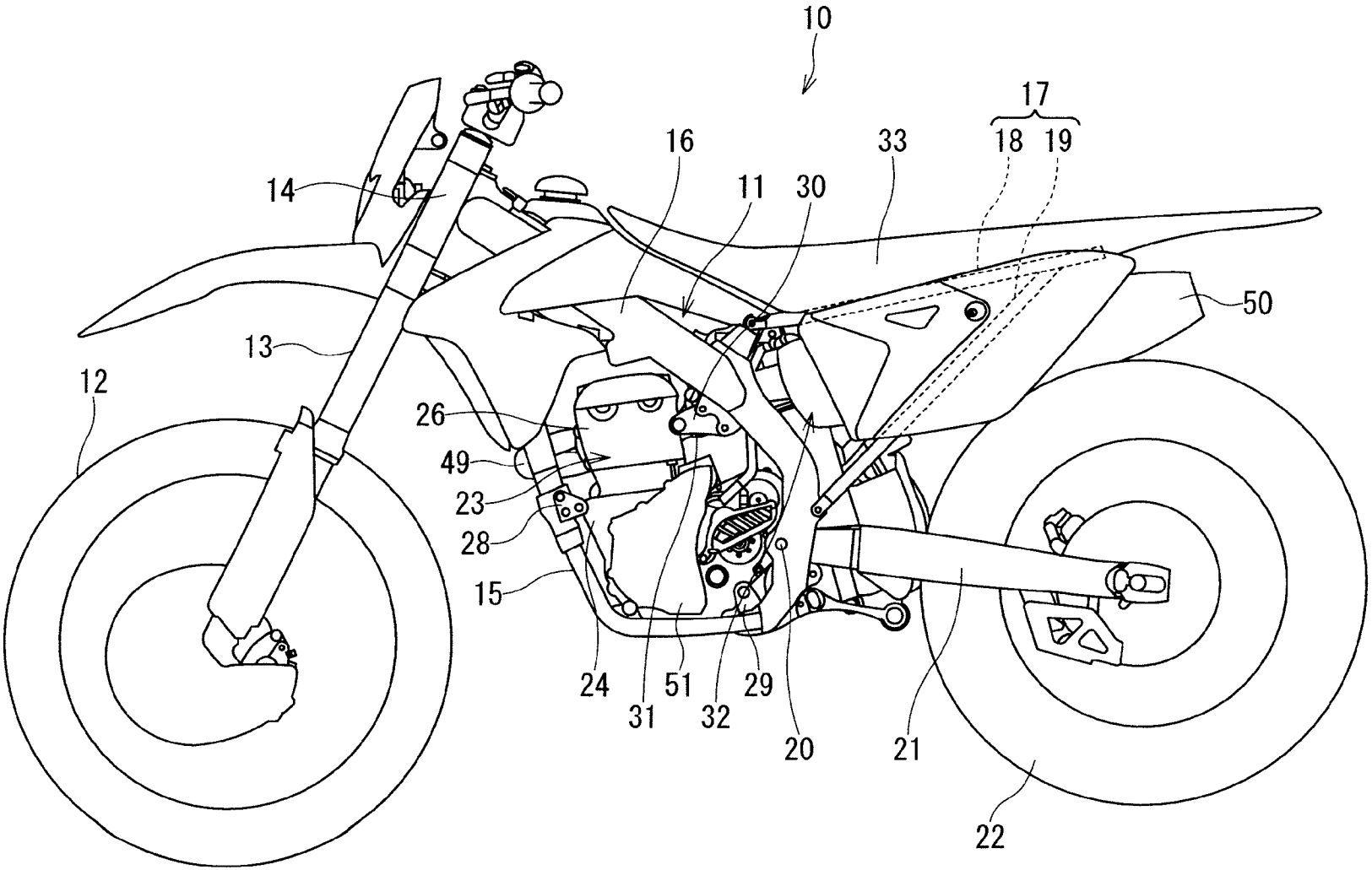
FIG. 1 is a left side view of a motorcycle mounted with a single cylinder four stroke engine, which is one embodiment of an internal combustion engine according to the present invention.

A motorcycle 10 shown in FIG. 1 is a vehicle capable of off-road riding type, for example, mounted with a single cylinder four stroke engine.

The motorcycle 10 is equipped with a head pipe 14 at a front portion of a vehicle frame 11 (i.e., body frame 11), and the head pipe 14 supports a front fork 13 and a front wheel 12 to be swiveled with respect to the vehicle body.

A down tube 15 extending downward and a main frame 16 extending rearward are attached, for example, by means of welding, to the rear portion of the head pipe 14. The down tube 15 once extending downward is then bent to the rear and coupled to a lower end of the main frame 16.

A seat rail unit 17 is disposed at the rear portion of the main frame 16. The seat rail unit 17 includes an upper rail 18 that is fastened to a center portion of the main frame 16 and extends rearward therefrom and also includes a lower rail 19 that extends upward and rearward from a lower portion of the main frame 16. The upper rail 18 and the lower rail 19 are coupled to each other at one ends thereof, and the space defined by a portion of the main frame 16, the upper rail 18 and the lower rail 19 is configured so as to provide a triangular shape in a side view.

The main frame 16 is provided with a pivot shaft 20 to which a swing arm 21 is pivotally supported to be swingable, and a rear wheel 22 is rotatably supported to this swing arm 22 which is driven by a driving force of an engine 23 described later via a drive chain or the like, not shown.

An engine 23, which is an internal engine, is mounted in the space defined by the main frame 16 and the down tube 15. The engine 23 is firmly fixed to the vehicle frame 11 with a front mount bracket 28 that couples a front portion of a crankcase unit 24 to the down tube 15, a rear mount bracket 29 that couples a rear portion of the crankcase unit 24 to the main frame 16, and an upper mount bracket 30 that couples a cylinder head 26 to the main frame 16.

A fuel control device 31, which may also serve as a fuel supply device, is coupled to the rear portion of the cylinder head 26, and the fuel control device 31 is provided with a throttle valve or the like that changes air fuel amount to be supplied to the engine 23 in response to an accelerator operation. In the above meanings, the reference numeral may be also called throttle body, or more in detail, air-fuel mixture control device including a throttle valve and an injector. Herein, the device shown with reference numeral 31 is called as fuel control device as mentioned above.

Furthermore, an air cleaner 32 is connected to the rear portion of the fuel control device 31. The air cleaner 32 serves to supply clean air to the fuel control device 31 and is fastened to the upper rail 18 at an upper surface and also fastened to the lower rail 19 at a lower surface by means of bolts through a bracket, not shown.

A seat 33 is disposed above the air cleaner 32 and supported by the seat rail unit 17.

Figure 2:
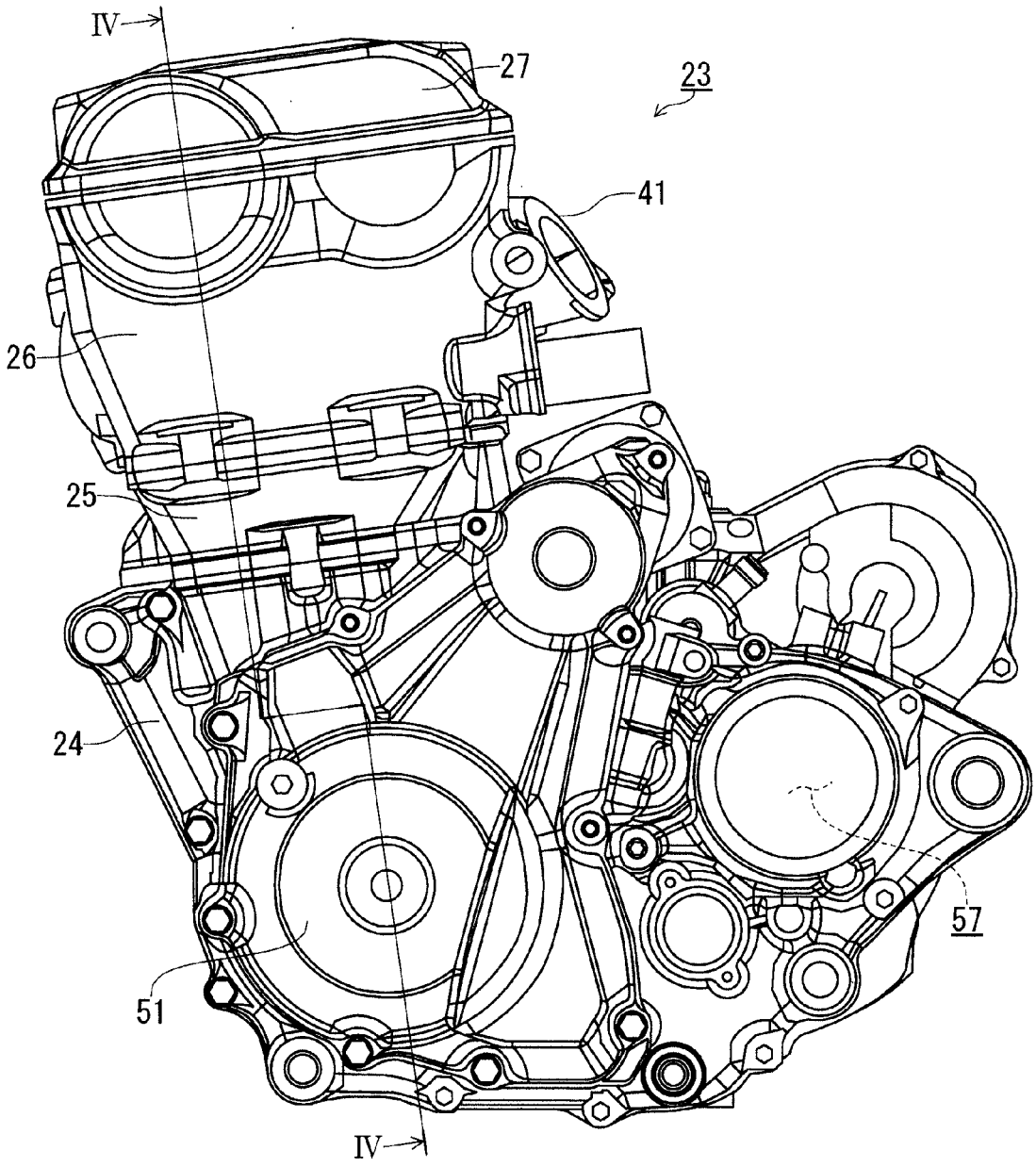
FIG. 2 is a left side view of the engine shown in FIG. 1, in an enlarged scale.
Figure 3:
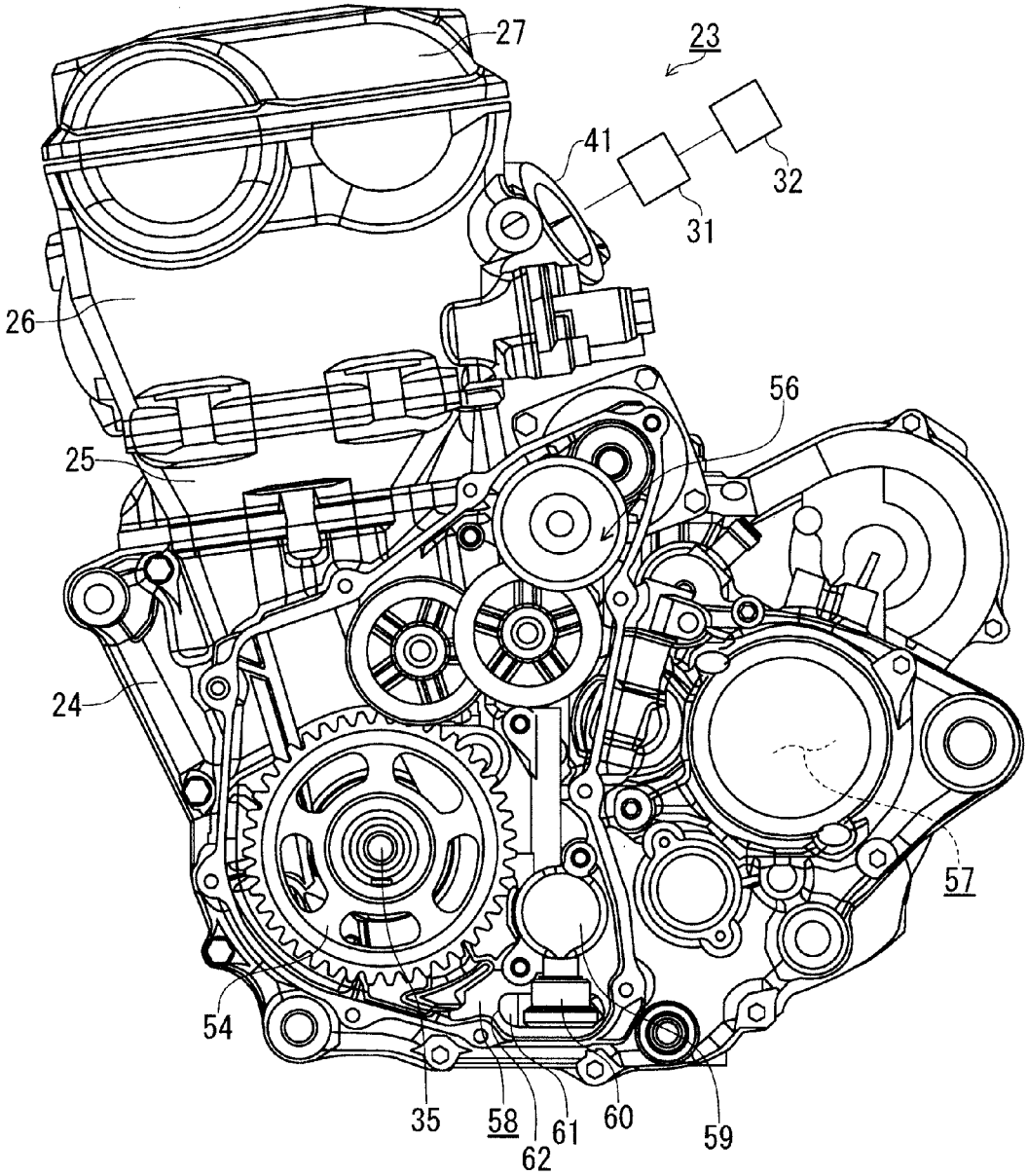
FIG. 3 is a left side view of the engine shown in FIG. 2 from which a magneto cover is removed.
Figure 4:
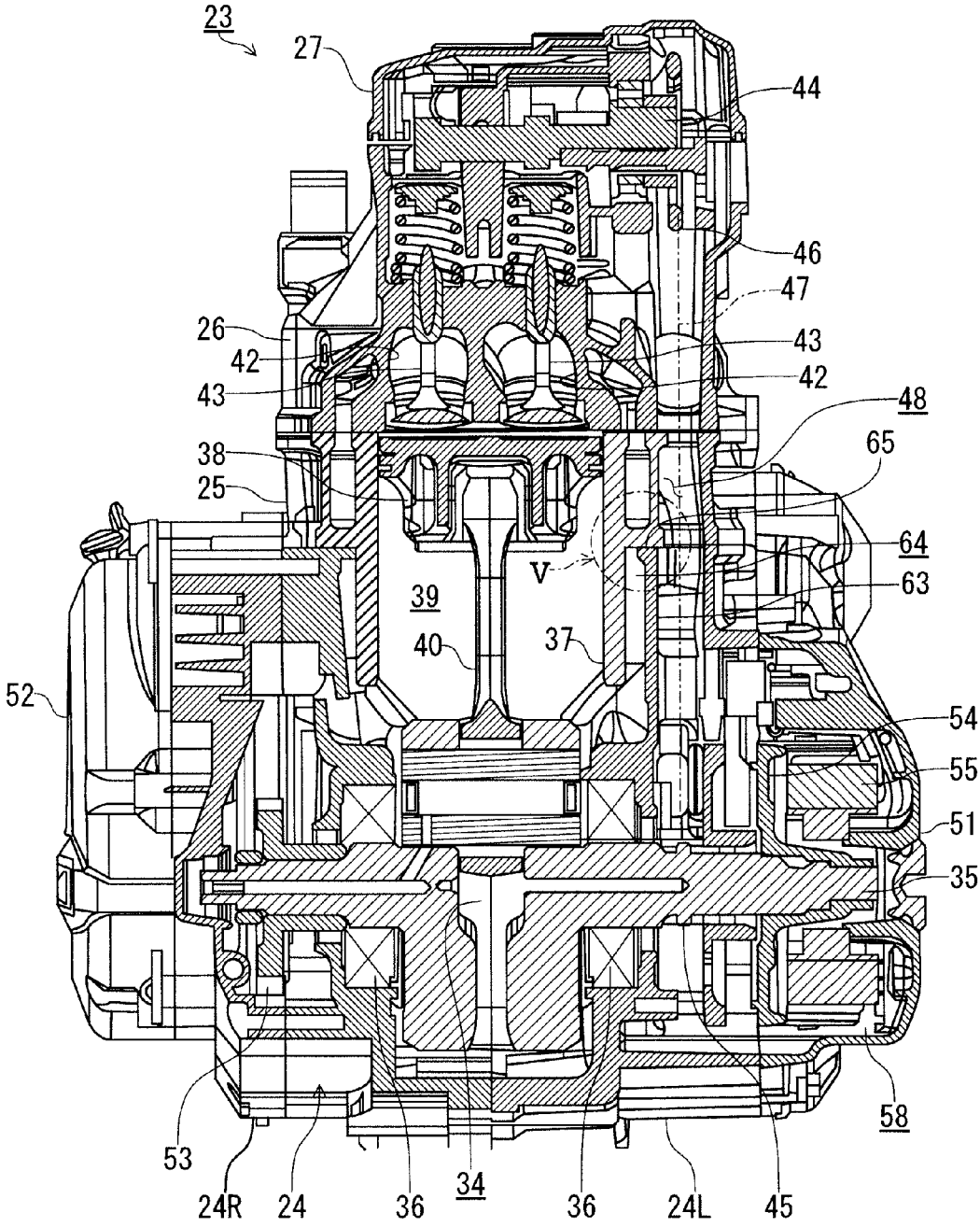
FIG. 4 is a cross-sectional view taken along the line IV-IV in FIG. 2.

As shown in FIGS. 2, 3 and 4, the engine 23 is a single cylinder four stroke engine and includes the crankcase unit 24 in a lower portion thereof, a cylinder 25 disposed on the crankcase unit 24, and the cylinder head 26 disposed on the upper surface of the cylinder 25 in this order. The crankcase unit 24, the cylinder 25 and the cylinder head 26 are integrally coupled together by means of penetrating bolt, not shown, penetrating from the cylinder head 26 to the crankcase unit 24. A head cover 27 is fixed to a top portion of the cylinder head 26.

Figure 6:
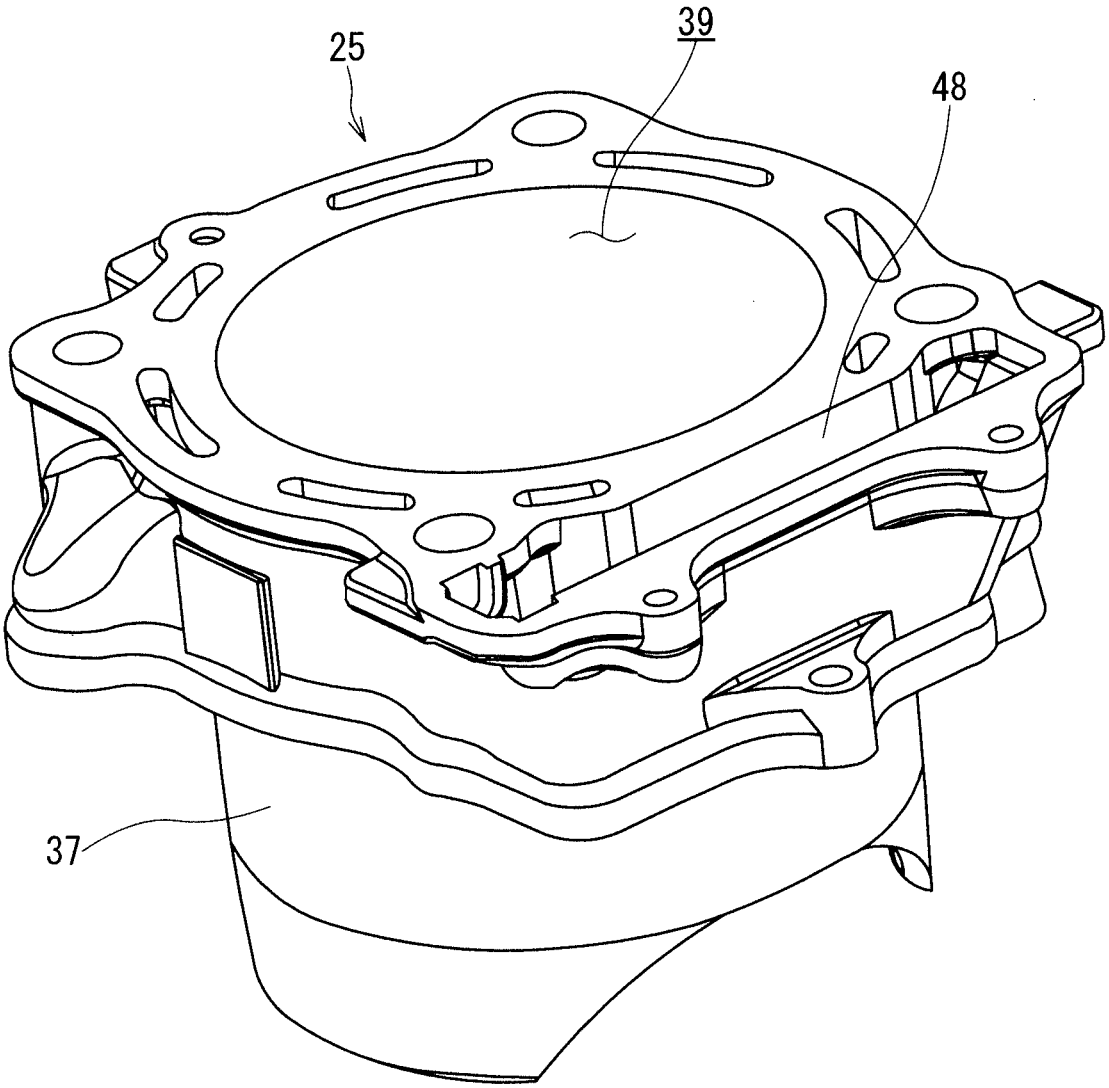
FIG. 6 is a perspective view of a cylinder shown in FIG. 4.

The crankcase unit 24 forms a closed crank chamber 34, and a crank shaft 35 is rotatably supported by a bearing member 36 in the crank chamber 34. The cylinder 25 is formed with a projecting portion 37 extending downward (toward) the crankcase unit 24 as shown in FIG. 6, and in this meaning, the projecting portion 37 may be called "skirt portion 37" hereinafter. The cylinder 25 including the skirt portion 37 is formed with a cylinder bore 39 in which a piston 38 (FIG. 4) is moved reciprocally. The cylinder 25 is coupled to the crankcase unit 24 in a state in which with the skirt portion 37 is inserted in the crankcase unit 24. The piston 38 is coupled to the crank shaft 35 via a connecting rod 40 so that the reciprocating motion of the piston 38 is converted into a rotational motion of the crank shaft 35.

The cylinder head 26 is formed with an intake port 41 (FIG. 3) and an exhaust port 42 (FIG. 4) that communicate with the interior of the cylinder 25. The intake port 41 is incorporated with an intake valve, not shown, that is opened and closed at an arbitrary timing by operation of an intake-side cam shaft, not shown, and also, the exhaust port 42 is incorporated with an exhaust valve 43 that is opened and closed at an arbitrary timing by operation of an exhaust-side cam shaft 44.

Further, a driven sprocket 46 is provided for the intake-side cam shaft and the exhaust-side cam shaft 44, respectively, to be integrally rotatable therewith, and a cam chain 47 is wound around the driven sprocket 46 and a driving sprocket 45 of the crank shaft 35. According to such arrangement, when the crank shaft 35 is driven and rotated, the intake valve and the exhaust valve 43 are opened and closed at an arbitrary timing described above. Furthermore, a cam chain chamber 48 is continuously formed to the crankcase unit 24, the cylinder 25 and the cylinder head 26 so as to accommodate the cam chain 47 therein.

The intake port 41 shown in FIG. 3 is coupled to the fuel control device 31 at the rear portion of the engine 23, and the air cleaner 32 is coupled to the rear portion of the fuel control device 31. Furthermore, the exhaust port 42 is coupled to an exhaust pipe 49 at the front portion of the engine 23 as shown in FIG. 1. The exhaust pipe 49 extends rearward of the vehicle body, and a silencer 50 is connected to a tip end portion of the exhaust pipe 49.

The crankcase unit 24 is composed of a left-side crankcase 24L and a right-side crankcase 24R coupled to each other, as shown in FIG. 4. The bearing member 36 supporting the crank shaft 35 is disposed in each of the left-side crankcase 24L and the right-side crankcase 24R. A magneto cover 51 is attached to the left-side crankcase 24L, and on the other hand, a clutch cover 52 is attached to the right-side crankcase 24R.

A primary driving gear 53 is fitted to the right end of the crank shaft 35 to be integrally rotatable together. The primary driving gear 53 and a clutch, not shown, disposed on the rear side of the primary driving gear 53 are housed in the clutch cover 52. The primary driving gear 53 is engaged with a primary driven gear, not shown, mounted on the outer peripheral portion of the clutch. According to such arrangement, the driving force of the engine 23 (i.e., the rotational force of the crank shaft 35) is transmitted to the rear wheel 22 through the primary driving gear 53, the primary driven gear, the clutch, a transmission, not shown, and a driving chain, not shown, in this order.

A flywheel magneto 54 is fitted to the left-side end of the crank shaft 35 to be integrally rotatable therewith. The flywheel magneto 54 has a cup shape, and a stator 55 fixed to the magneto cover 51 is disposed in the flywheel magneto 54. The stator 55 includes a magnet around which a coil is wound. When the crank shaft 35 rotates, the flywheel magneto 54 also rotates about the stator 55 to thereby generate electric power. The generated electric power is accumulated in a battery, not shown, mounted on the vehicle body.

The transmission described above is housed in a transmission chamber 57 separated from the crank chamber 34 on the rear side of the crankcase unit 24, as shown in FIG. 2. The flywheel magneto 54 and the starter 55 shown in FIG. 4 are housed in a magneto chamber 58 defined by the crankcase unit 24 (the left-side crankcase 24L) and the magneto cover 51. The magneto chamber 58 also houses a gear train of a stator mechanism 56 as shown in FIG. 3.

The engine 23 described above adopts a dry sump lubrication system, and the transmission chamber 57 formed at the rear portion of the engine 23 serves as an oil tank.

As shown in FIGS. 3 and 4, the magneto chamber 58 houses a scavenging pump 59. A lubricant oil accumulated at the bottom of the magneto chamber 58 is collected through a strainer 60 through suctioning operation by the scavenging pump 59 and delivered to the transmission chamber 57. The lubricant oil is accumulated at the bottom of the transmission chamber 57 by a predetermined constant amount and then supplied to respective reduction gears for lubricating them. The lubricant oil is further supplied to the sliding surface of the intake-side cam shaft and the exhaust-side cam shaft 44, the bearing member 36 for the crank shaft 35, a piston jet, not shown, and the like for the lubrication through an opening formed in the bottom of the transmission chamber 57 by the action of a feed pump, not shown, mounted on a side wall of the right-side crankcase 24R. Then, the lubricant oil drips into the crank chamber 34 or the magneto chamber 58.

The piston jet is disposed on the upper portion of the crankcase unit 24 so as to face the bottom of the piston 38 from the lower side of a skirt portion of the piston 38 and serves to eject the lubricant oil toward the bottom of the piston 38. In this way, the piston 38 is lubricated and cooled.

When the piston 38 moves from the top dead center to the bottom dead center, the pressure in the crank chamber 34 varies to produce a positive pressure and then to open a reed valve 61 (FIG. 3), thereby discharging the lubricant oil having dripped into the crank chamber 34 into the magneto chamber 58. The reed valve 61 is a one-way valve (i.e., a check valve) that is disposed in an oil communicating hole 62 communicating the crank chamber 34 and the magneto chamber 58 with each other and that permits only the flow of the lubricant oil from the crank chamber 34 to the magneto chamber 58. The reed valve 61 is closed when the piston 38 moves from the bottom dead center to the top dead center.

Figure 5:
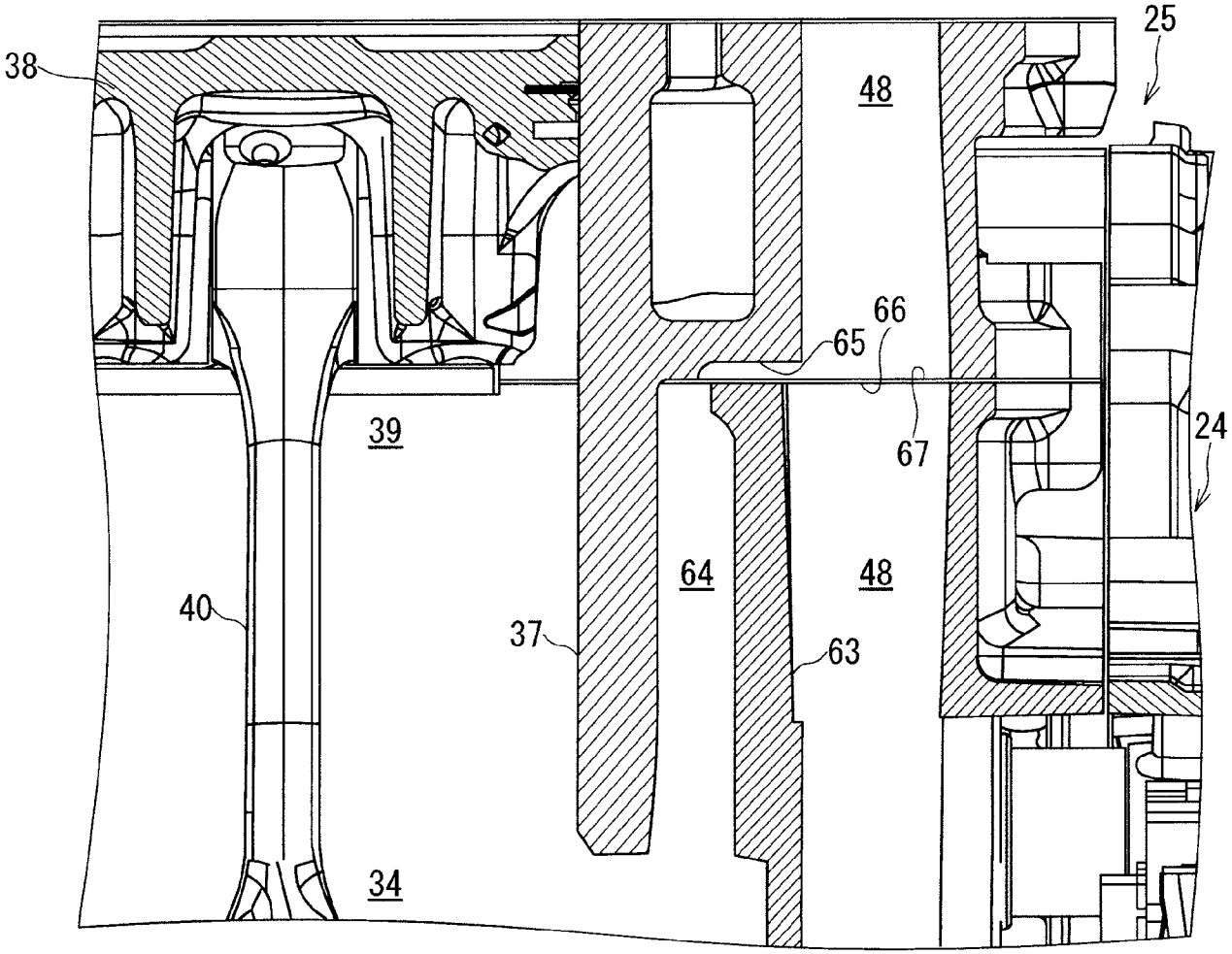
FIG. 5 is an enlarged cross-sectional view of an encircled portion V in FIG. 4.

As shown in FIGS. 4 and 5, when the crankcase unit 24 and the cylinder 25 are coupled to each other, a space 64 is formed between the skirt portion 37 of the cylinder 25 and a wall section 63 of the crankcase unit 24 located at the outer side of the skirt portion 37. The space 64 constitutes one part of the crank chamber 34 having the closed structure, and the cam chain chamber 48 described above is adjacent to the space 64. The cam chain chamber 48 is a space outside the crank chamber 34.

A communicating groove 65 serving as a communicating passage or member that connects the space 64 and the cam chain chamber 48 to each other is formed at least one of the crankcase unit 24 and the cylinder 25. According to this embodiment, the communicating groove 65 is formed in a cylinder-side contact surface 66 (cylinder surface) in contact with the crankcase unit 24. Alternatively, the communicating groove 65 may be formed in a crankcase-unit-side contact surface 67 (crankcase surface) in contact with the cylinder 25, and moreover, alternatively, the communicating groove 65 may be formed in both the cylinder-side contact surface 66 and the crankcase-unit-side contact surface 67 so that the communicating grooves 65 are opposed to each other.

If no communicating groove 65 is formed, the crank chamber 34 has the closed structure, and the read valve 61 is closed when the piston 38 moves from the bottom dead center to the top dead center, which results in a state in which an excessive negative pressure is produced in the crank chamber 34.

However, in a case where such communicating groove 65 is formed as in the present embodiment, the communicating groove 65 serves to connect the space 64 and the cam chain chamber 48 to each other, so that no excessive negative pressure is produced in the crank chamber 34 even when the piston 38 moves from the bottom dead center to the top dead center.

Accordingly, the following advantageous effects and functions may be achieved according to the present embodiment mentioned above.

In the structure of the present embodiment, the space 64 between the skirt portion 37 of the cylinder 25 and the wall section 63 of the crankcase unit 24 located at the outer side of the skirt portion 37 is one part of the crank chamber 34 and is in communication with the cam chain chamber 48 outside the crank chamber 34 through the communicating groove 65, and in addition, since the communicating groove 65 is located at the outer side of the skirt portion 37. Therefore, any droplet of the lubricant oil in the crank chamber 34 is not introduced into the communicating groove 65, and thus, the communicating groove 65 is not blocked by abrasion particles in the oil. Furthermore, since the piston 38 reciprocating in the cylinder bore 39 of the cylinder 25 does not block or close the communicating groove 65, the communicating groove 65 can prevent, with high reliability, occurrence of an excessive negative pressure in the crank chamber 34 during the movement of the piston 38 from the bottom dead center to the top dead center. Thus, any force is not generated in the crank chamber 34 for preventing the movement of the piston 38 to the top dead center, and accordingly, the pumping loss can be reduced, so that the starting performance and acceleration characteristics of the engine 23 can be remarkably improved.

In the forgoing description, although the present invention has been described with reference to the preferred embodiment, the present invention is not limited to the specific embodiment, and many other changes and modifications may be made without departing from the scopes of the appended claims.

For example, in the embodiment described above, the communicating member is composed of the communicating groove 65 formed in the contact surface of the crankcase unit 24 and/or the cylinder 25. However, the communicating member may be composed of a notch or groove formed in a gasket disposed on the contact surface.

Furthermore, in the embodiment described above, the communicating groove 65 serving as the communicating member is formed in the contact surface of the crankcase unit 24 and/or the cylinder 25. However, for example, the communicating member may be formed to the wall section 63 located at the outer side of the skirt portion 37 of the cylinder 25 in the form of a through hole that connects the space 64 and the cam chain chamber 48 formed on the side opposite to the wall section 63.

Still furthermore, in the embodiment described above, although the engine 23 is described as a single cylinder four stroke cycle engine is described, a multi-cylinder four stroke engine may be used as the engine 23, or a two-stroke engine may be applied as the engine 23 of the present embodiment.

What is claimed is:

1. An internal combustion engine comprising:

a crankcase unit forming a crank chamber;

a cylinder having a cylinder bore and a projecting portion extending toward the crankcase unit so as to be coupled thereto;

a piston that reciprocates in the cylinder bore of the cylinder; and a crank shaft rotatably supported in the crankcase unit, in which a reciprocating motion of the piston is converted into a rotational motion of the crank shaft, wherein the crankcase unit has a wall section and a space is formed between the projecting portion of the cylinder and the wall section of the crankcase unit when the crank case unit and cylinder having the projecting portion is coupled, and the space formed between the projecting portion of the cylinder and the wall section of the crankcase unit and an outside space of the crank chamber are communicated through a communicating passage which is provided to the cylinder, wherein the crankcase unit includes at least laterally arranged two crankcases, and wherein the space outside the crank chamber constitutes a cam chain chamber disposed adjacent to the crank chamber.

2. The internal combustion engine according to claim 1, wherein the communicating passage is composed of a communicating groove formed to one of a cylinder-side contact surface and a crankcase-unit-side contact surface of contact surfaces of the crankcase unit and the cylinder.

3. The internal combustion engine according to claim 2, wherein the communicating groove is formed to the cylinder-side contact surface of the cylinder.

4. The internal combustion engine according to claim 1, wherein the communicating passage is composed of communicating groves formed to both a cylinder-side contact surface and a crankcase-unit-side contact surface of contact surfaces of the crankcase unit and the cylinder.

* * * * *